US012013174B2

(12) United States Patent
Mefford et al.

(10) Patent No.: US 12,013,174 B2
(45) Date of Patent: Jun. 18, 2024

(54) BEVERAGE COOLING DEVICE

(71) Applicant: Vermillion Innovations LLC, Los Angeles, CA (US)

(72) Inventors: Adam V. Mefford, Los Angeles, CA (US); David Goetz, Los Angeles, CA (US)

(73) Assignee: Vermillion Innovations, LLC, Metairie, LA (US)

( * ) Notice: Subject to any disclaimer, the term of this patent is extended or adjusted under 35 U.S.C. 154(b) by 512 days.

(21) Appl. No.: 17/364,721

(22) Filed: Jun. 30, 2021

(65) Prior Publication Data

US 2023/0003439 A1 Jan. 5, 2023

(51) Int. Cl.

| | |
|---|---|
| ***F25D 25/00*** | (2006.01) |
| ***F25D 1/02*** | (2006.01) |
| ***F25D 3/02*** | (2006.01) |
| ***F25D 31/00*** | (2006.01) |

(52) U.S. Cl.

CPC ..... *F25D 25/00* (2013.01); *F25D 1/02* (2013.01); *F25D 3/02* (2013.01); *F25D 31/007* (2013.01); *F25D 2303/0843* (2013.01); *F25D 2331/803* (2013.01); *F25D 2331/805* (2013.01); *F25D 2400/28* (2013.01)

(58) Field of Classification Search

CPC ... F25D 25/00; F25D 1/02; F25D 3/02; F25D 31/007; F25D 2303/0843; F25D 2331/803; F25D 2331/805; F25D 2400/28

See application file for complete search history.

(56) References Cited

U.S. PATENT DOCUMENTS

| | | | | |
|---|---|---|---|---|
| 5,720,171 | A * | 2/1998 | Osterhoff | A47J 36/2461 62/298 |
| 10,746,460 | B2 | 8/2020 | Dorus | |
| 10,974,635 | B1 * | 4/2021 | Tiringo | B60N 3/104 |
| 2007/0065312 | A1 | 3/2007 | Whitehouse et al. | |
| 2016/0037947 | A1 * | 2/2016 | Goetz | A47G 23/0241 220/737 |
| 2021/0025634 | A1 | 1/2021 | Alexander et al. | |

FOREIGN PATENT DOCUMENTS

| | | | | |
|---|---|---|---|---|
| DE | 19926590 | A1 * | 12/2000 | B60N 3/102 |
| EP | 2095044 | B1 * | 11/2017 | F25D 17/045 |
| GB | 2390586 | A * | 1/2004 | B60N 3/101 |

OTHER PUBLICATIONS

PCT/US2022/035760, International Search Report and Written Opinion dated Nov. 18, 2022 (10 pages).

PCT/US2022/035760, International Preliminary Report on Patentability dated Jan. 11, 2024 (7 pages).

* cited by examiner

*Primary Examiner* — Emmanuel E Duke

(74) *Attorney, Agent, or Firm* — LOZA & LOZA, LLP; David S. Sarisky

(57) ABSTRACT

A beverage cooling device including a housing having a top wall, a side wall, and a cavity. A motor is operatively connected to a power supply within the housing. A container engagement member is rotatably coupled to the motor and configured to receive torque from the motor when the motor is actuated. The container engagement member includes an aperture for receiving an inserted beverage container and a plurality of spring members configured to deform upon insertion of the beverage container into the aperture and to provide a gripping force upon the beverage container.

20 Claims, 7 Drawing Sheets

BEVERAGE COOLING DEVICE

TECHNICAL FIELD

The technology discussed below relates generally to a beverage cooling device, and more particularly, a device for mounting on containers to expedite the cooling of a beverage within the container.

BACKGROUND

Beverages of all kinds are often more desirable when consumed at cold temperatures. Such beverages are often distributed in and consumed from beverage containers, but these beverages are not always obtained at a cold temperature; and even if obtained when cold, their containers typically offer little to no insulation for maintaining the cold temperatures desired by consumers. Furthermore, refrigeration of the beverage containers in a refrigerator or cooler can take a substantial amount of time.

Beverage containers can be more rapidly cooled by exposure to cooled gas or liquid in motion. For example, a beverage container can be submerged into a drum containing a supercooled liquid that is pumped to flow around the beverage container. However, as with the refrigerator or portable cooler, consumers must be near the drum, ready to consume the beverage before the poorly insulated beverage container allows the temperature to rise. In addition, supercooled liquid is often expensive to procure and maintain at desired temperature, and the pump can be costly to run and keep in service.

Manual rotation of beverage containers in a suitable cooling medium, such as ice water, can be an effective solution, speeding up the cooling process. However, this can be time consuming and inefficient because it is difficult to obtain, and maintain a high rotation speed. Motorized rotational devices have been developed to assist in the rapid chilling of beverage containers; for example, see U.S. Pat. No. 10,034,565 for several such devices developed by the applicant of this document. However, there remains room for improvement and advancement in such devices' functionality and performance.

SUMMARY

The following presents a simplified summary of one or more aspects of the present disclosure, in order to provide a basic understanding of such aspects. This summary is not an extensive overview of all contemplated features of the disclosure, and is intended neither to identify key or critical elements of all aspects of the disclosure nor to delineate the scope of any or all aspects of the disclosure. Its sole purpose is to present some concepts of one or more aspects of the disclosure in a simplified form as a prelude to the more detailed description that is presented later.

This disclosure describes and enables a beverage cooling device that rotates or spins a beverage container in a cooling medium (e.g., ice), to provide rapid cooling of the contents of canned or bottled beverages. In some embodiments, the beverage cooling device is a hand held, buoyant, water tight device that easily engages the top of a can, bottle, or other suitable beverage container. The beverage cooling device includes a housing for a motor, and an attached container engagement member for engaging or holding the beverage container. The container engagement member is coupled to the motor and rotatably engaged with the housing, such that the container engagement member is able to freely rotate relative to the housing. The container engagement member may be attached to a drive shaft of the motor such that it is able to rotate when the motor is actuated. In some examples, the motor is actuated by an on/off switch or button. The motor rotates the container engagement member when actuated, thus enabling the rotation of an engaged bottle, can, or other container. Rapid rotation of the beverage container in contact with a chilling substance such as ice or ice water results in a rapid chilling of the contents of the beverage container.

These and other aspects of the invention will become more fully understood upon a review of the detailed description, which follows. Other aspects, features, and embodiments of the present invention will become apparent to those of ordinary skill in the art, upon reviewing the following description of specific, exemplary embodiments of the present invention in conjunction with the accompanying figures. While features of the present invention may be discussed relative to certain embodiments and figures below, all embodiments of the present invention can include one or more of the advantageous features discussed herein. In other words, while one or more embodiments may be discussed as having certain advantageous features, one or more of such features may also be used in accordance with the various embodiments of the invention discussed herein. In similar fashion, while exemplary embodiments may be discussed below as device, system, or method embodiments it should be understood that such exemplary embodiments can be implemented in various devices, systems, and methods.

BRIEF DESCRIPTION OF THE DRAWINGS

The invention may be better understood by referring to the following figures.

The components in the figures are not necessarily to scale, emphasis instead being placed upon illustrating the principles of the invention. In the figures, like reference numerals designate corresponding parts throughout the different views.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Figure 1:
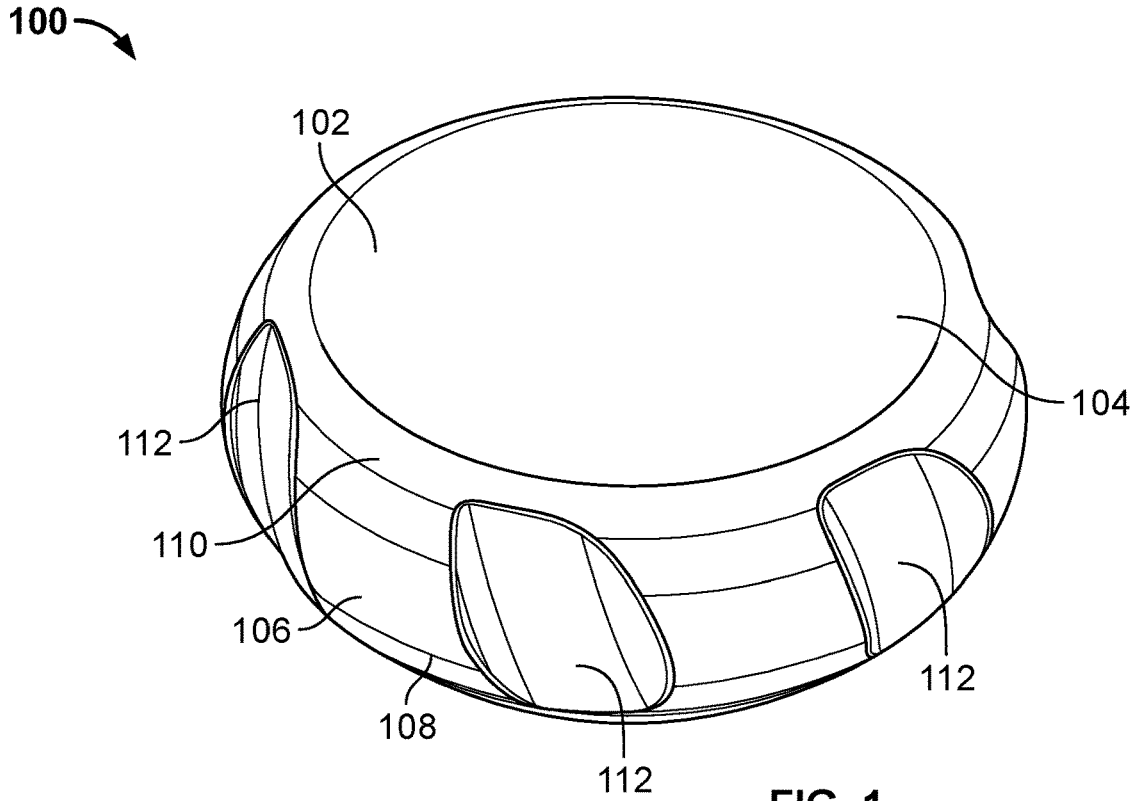
FIG. 1 is a top perspective view of one example of an implementation of a beverage cooling device according to some aspects of the present disclosure.

FIG. 1 is a top perspective view of one example of a beverage cooling device 100 according to some aspects of the present disclosure. As illustrated in FIG. 1, the beverage cooling device 100 is a hand held device having a housing 102 with a top wall 104 disposed inside an annular side wall 106 for encasing a motor (not shown) operatively connected to a power supply (not shown), e.g., a rechargeable battery or disposable batteries. The side wall 106 includes a lower end 108 that is disposed opposite an upper end 110, the upper end 110 being positioned adjacent to and extending about the top wall 104.

Further, a plurality of divots 112 are radially spaced about a circumference of the side wall 106; and each divot 112 extends approximately from the upper end 110 to the lower end 108. The divots 112 further extend into the side wall 106 to define a concavely curved profile, allowing for ergonomic interaction between a user's fingers and the side wall 16 by way of the divots 112. In addition, the divots 112 allow for engagement with a cold medium (e.g. ice) so as to reduce or prevent rotation of the housing 102 and, combined with the buoyant properties of the housing 102, to maintain a stable posture during operation. As illustrated in FIG. 1, the divots 112 may have an oval-shape that is contorted at angle between the upper end 110 and the lower end 108.

Figure 2:
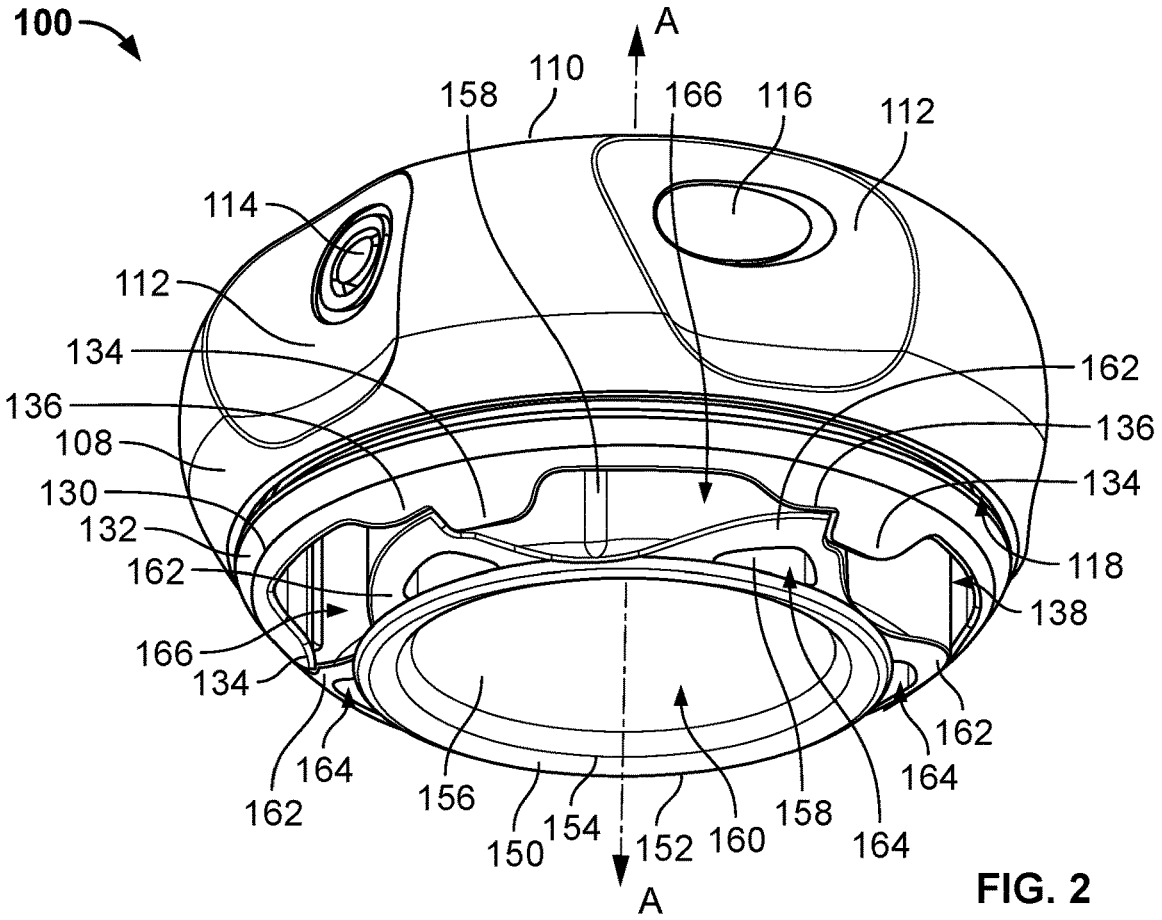
FIG. 2 is a bottom perspective view of the beverage cooling device of FIG. 1.

A power button 114 is located on the side wall 106 within one of the plurality of divots 112 for on/off actuation of the motor (not shown). As illustrated in FIG. 2, the power button 114 may be disc-shaped and mounted flush within the divot 112. In addition, the housing 102 includes a plug 116 located in another of the plurality of divots 112 different and spaced apart from the power button 114. The plug 116 may be removably sealingly connected to the housing 102 for enclosing an electrical connection to the power supply (not shown).

Additional features of the present invention are contemplated. For example, the top wall 104 may carry a number of indicia, or a label, or branding, or ornamentation, or a screen or display, or a pattern, or lights (e.g., LED lights), or a hook onto which a tether may be fastened, or a transmitter or a receiver. It is contemplated that the divots 112 may be shaped differently than as depicted herein, disposed at a different angle, and differently sized. In the present example, there are five divots 112, but it is contemplated that there may be any number of divots 112 disposed along the side wall 106 of the housing 102. For example, there may be three, four, six, seven, eight, nine, ten or more divots 112 provided on the housing 102, to improve grip and stability during operation. It is further contemplated that the housing may take any other suitable form or shape that provides for engagement with a cooling medium, not being limited to a form that includes divots as described herein. It is contemplated that the power button 114 and the plug 116 may be located elsewhere on the housing 102, such as on the top wall 104 or on the side wall 106 between the divots 112. It is further contemplated that the power button 114 and the plug 116 may be spaced apart from the housing 102 along a tether or cord (not shown). In some aspects, the beverage cooling device 100 may be controlled remotely via an internet or Bluetooth® connection with a controller or a smart phone.

FIG. 2 is bottom perspective view of the exemplary beverage cooling device 100 of FIG. 1. As illustrated in FIG. 2, the beverage cooling device 100 also has a container engagement assembly including a chassis 130 and a chuck 150. The chassis 130 is disposed within the cavity 118 of the housing 102, the cavity being defined beneath the top wall 104 and within the side wall 106, such that the cavity 118 extends from an underside of the top wall 104 to the lower end 108 of the side wall 106. The chassis 130 includes a drive ring 132 exposed below the lower end 108 of the side wall 106. The chassis 130, including the drive ring 132, may be composed of a rigid material, e.g., a thermoplastic or a thermopolymer. Due in part to the material, the chassis 130, including the drive ring 132, may be designed and configured to resist deformation or flexure, to be light weight, to be water-resistant and quick-drying, and to have appealing aesthetic or optical properties. In other examples, a housing 102 may not include a cavity 118; and the chassis 130 may instead be coupled to a bottom surface spanning across the lower end 108 of the housing 102. Regardless, the chassis 130 is rotatably coupled to the motor (not shown) so as to rotate about a rotation axis A, the chassis 130 also being rotatable relative to and independently of the housing 102.

In the present example, the drive ring 132 is annularly disposed along the lower end 108 and extends or projects inward from the lower end 108 at a downward angle relative to the top wall 104. The drive ring 132 carries a plurality of teeth 134 that connect to a plurality of ramps 136 spaced radially apart therealong. The plurality of teeth 134 and the plurality of ramps 136 are disposed adjacent one another, such that each tooth 134 is positioned adjacent each ramp 136. In the present example, the plurality of teeth 134 and the plurality of ramps 136 extend inwardly as inward projections into a receptacle 138 defined within the chassis 130, with each ramp 136 sloping inwardly toward each tooth 134 and each tooth 134 extending farther inwardly toward the rotation axis A and into the receptacle 138 than each ramp 136.

Figure 4:
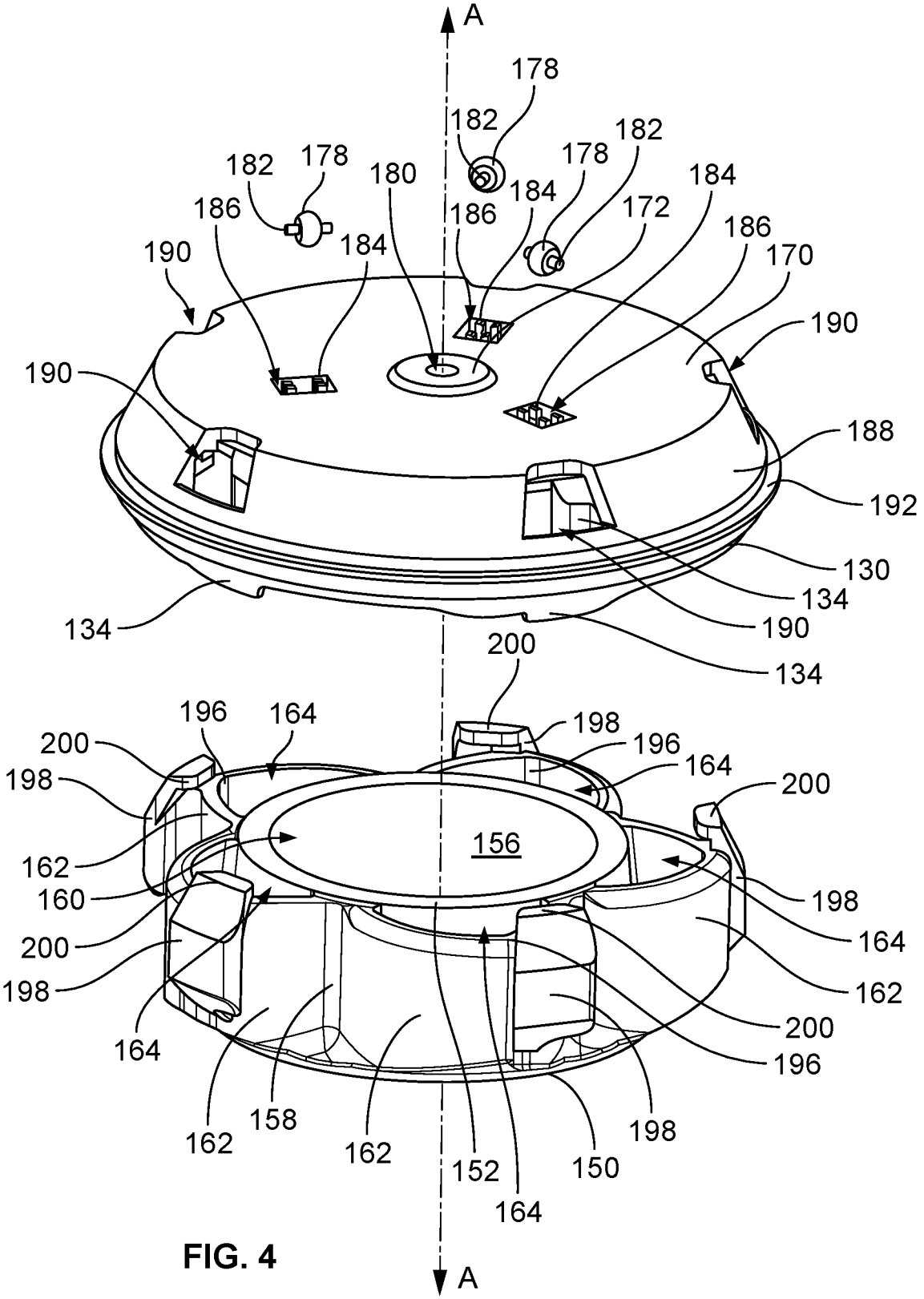
FIG. 4 is a top perspective view of an exploded view of a chassis and a chuck of the beverage cooling device.
Figure 5:
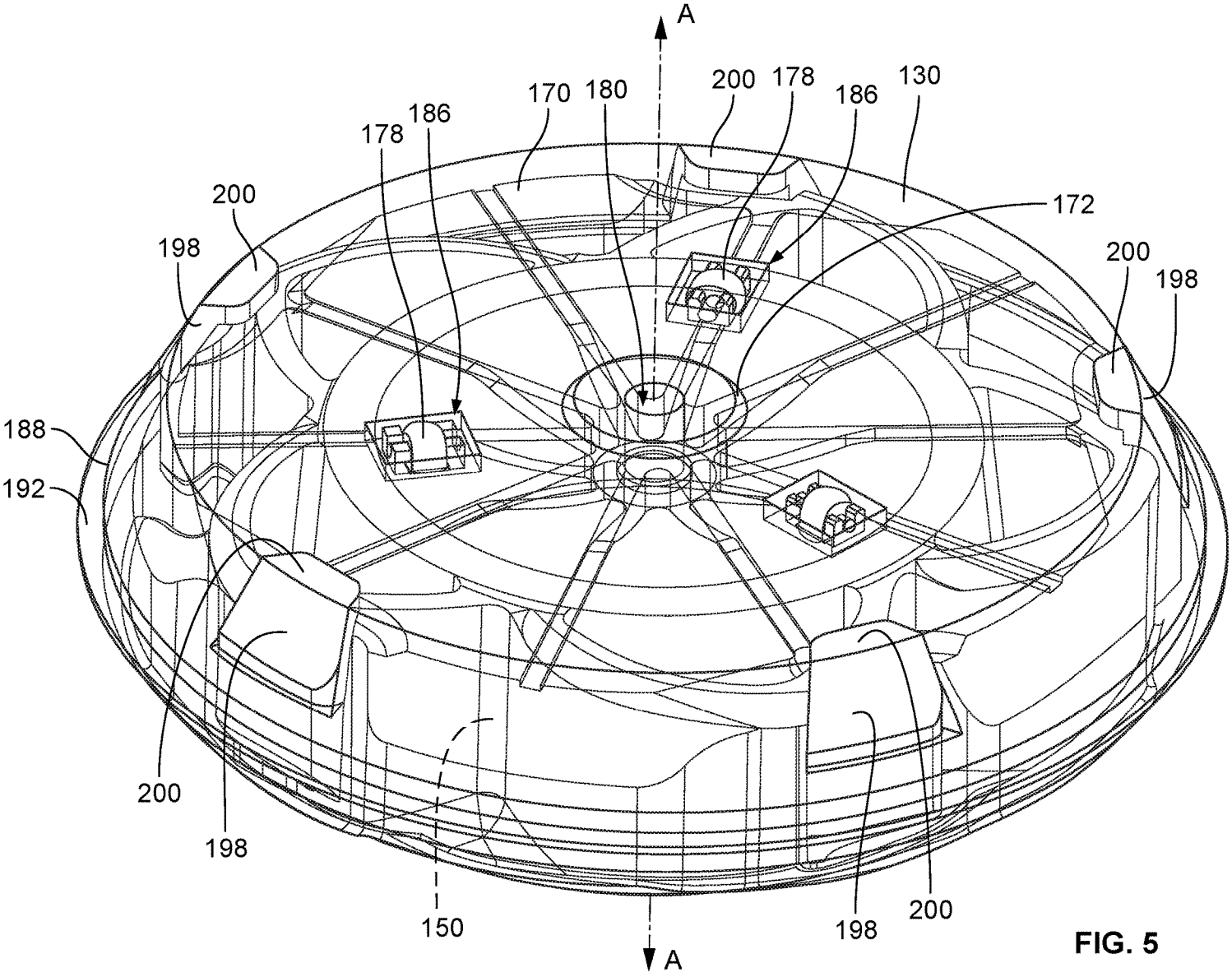
FIG. 5 is a top perspective view of the chassis and the chuck assembled together, with the chassis being depicted as partially transparent or translucent.

With continued reference to FIG. 2, drive ring 132 receives a container engagement member or chuck 150 within the receptacle 138 and among the plurality of teeth 134 and the plurality of ramps 136. In the illustrated example, the chuck 150 is a unitary, web-like structure that is removably engaged and axially aligned with the chassis 130 (as illustrated in FIGS. 4 and 5). In some examples, the chuck 150 may be composed of a different material than the chassis. For example, the chuck 150 may be formed of a flexible, resilient, and/or elastic material, e.g., silicone, thermoplastic polyurethane, ethylene vinyl acetate, or another suitable material. Due in part to the geometry and material, the chuck 150 is designed and configured to expand and stretch to accommodate beverage containers of a variety of shapes and sizes, such, e.g., cylindrical, frusto-conical, rectangular, triangular, polygonal, or any other geometry used for containing a beverage.

In addition, due to its geometry and material, the chuck 150 can accommodate beverage containers of varying materials, such as, e.g., glass, metal or metal alloy, cardboard, polymeric, composite, or any other material suitable for containing a beverage. That is, some implementations of a beverage cooling device according to the aspects and features disclosed herein may be capable of securely gripping and spinning a wide range of beverage container shapes and sizes, such as a small, rectangular cardboard juice box, a long-neck glass bottle, a cylindrical aluminum can, and/or many other sizes, shapes, and materials.

Further, the chuck 150 may be designed to resiliently return to its original shape, to be water resistant and quick-drying, to be easily cleaned, to remain sanitary, to withstand exposure to wide-ranging temperatures for prolonged periods, to provide sufficient friction and sealing function with a container so as to maintain a firm grip while being submersed in liquid or gaseous mediums, or a combination thereof, and to have appealing aesthetic or optical properties. For example, the chuck 150 may have multiple colorations or patterns thereon, or may contain phosphor that can be energized by exposure to light to allow some or all of the chuck 150 to radiate visible light in the dark (e.g., glow in the dark), or the chuck 150 may be partially or entirely transparent or translucent.

Figure 3:
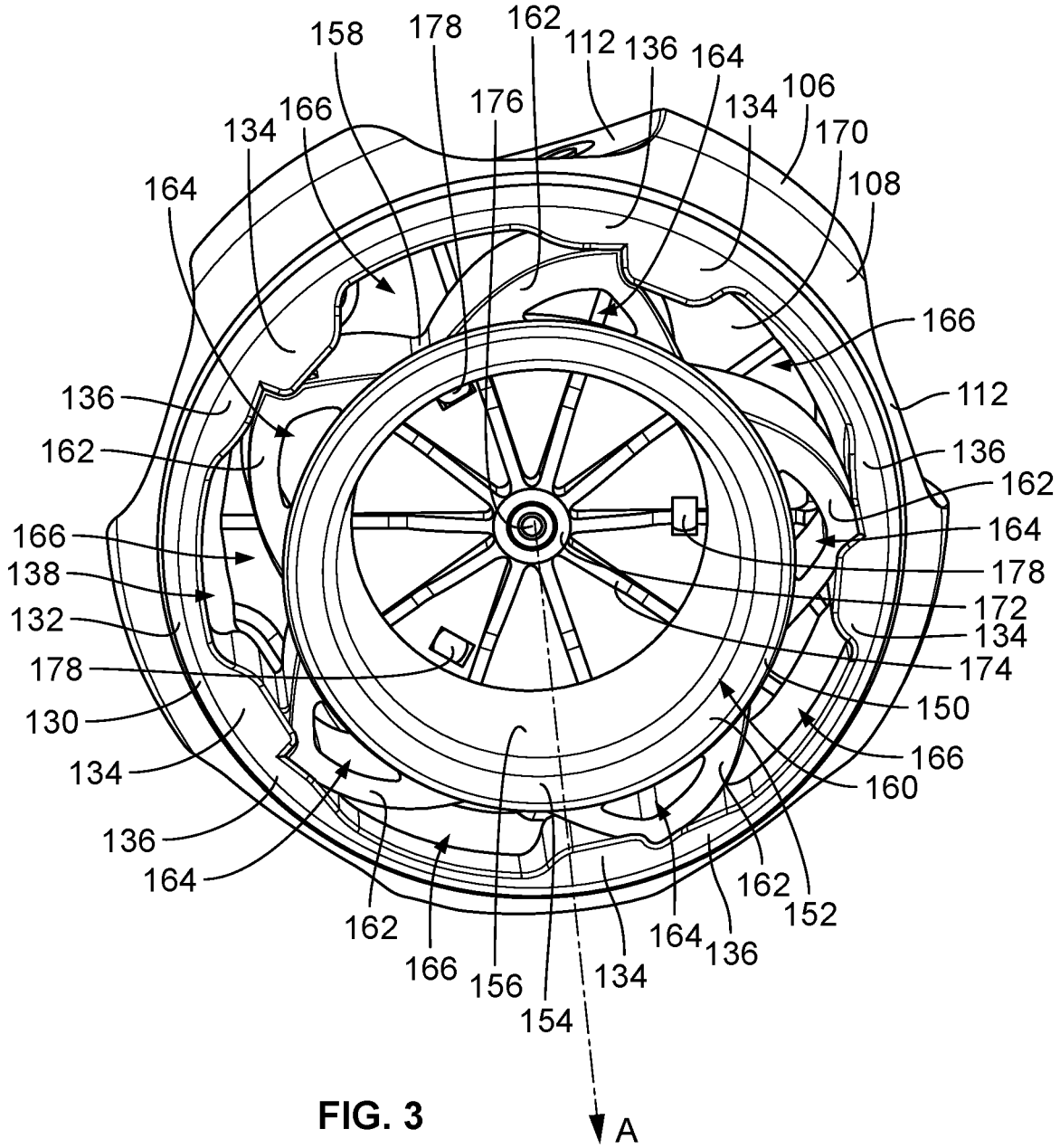
FIG. 3 is another bottom perspective view of the beverage cooling device.
Figure 7:
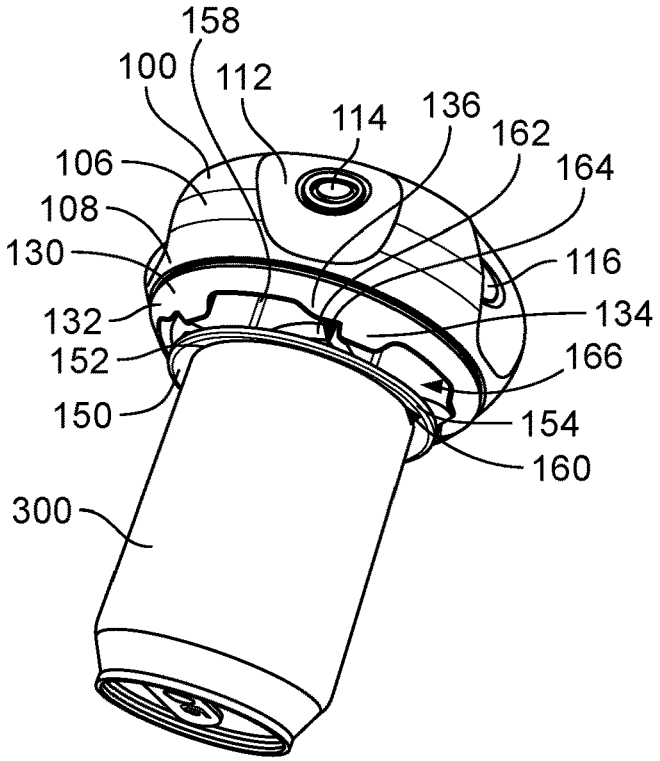
FIG. 7 is a bottom perspective view of the beverage container mounted to the beverage cooling device.

Referring to FIGS. 2 and 3, the chuck 150 includes an inner tube 152 (e.g., a band or a flange) having a generally tubular shape, and a flared lip 154 protrudes from an end of tube 152. The tube 152 includes an inner surface 156 and an outer surface 158, the inner surface 156 forming an aperture or mouth 160 for receiving at least a portion of a beverage container (e.g., an end of a beverage container as illustrated in FIG. 7). A plurality of collapsible projections or springs 162 extend from the outer surface 158 of the tube 152, each of the springs 162 having an open, generally tubular shape with an inner opening or gap 164 being defined between the outer surface 158 and each spring 162. Further, an outer gap 166 is defined between each spring 162 and adjacent the drive ring 132. When the chuck 150 is installed within the receptacle 138 of the chassis 130, the springs 162 removably and slidably contact the drive ring 132. Differently said, the springs 162 can be pressed against the drive ring 132 so as to become partially deformed or compressed toward the outer surface 158 of the tube 152.

As illustrated in FIG. 3, the plurality of springs 162 may be radially symmetrically arranged along the outer surface 158 of the tube 152. The outer gap 166 may be disposed in-between each spring 162. In the illustrated example, a ratio of springs 162 to teeth 134 is 1:1 and a ratio of teeth 134 to ramps 136 is also 1:1. In the present example, there are five springs 162, five teeth 134, and five ramps 136. However, it is contemplated that there may be greater or fewer springs 162, teeth 134, and/or ramps 136, such as four, or three, or six, or seven, or eight, or nine, or even ten springs 162, teeth 134, and ramps 136. It is also contemplated that the ratio of springs 162 to teeth 134 could be different from 1:1, and that the ratio of teeth 134 to ramps 136 could be different from 1:1. Further, it is contemplated that the springs 162 may be triangular- (as illustrated), rectangular-, trapezodial-, cylindrical-, hexagonal-, or otherwise polygonal-shaped.

Each spring 162 has a spring force that can be manipulated by the particular geometry, thickness, and material selected. In combination, the spring force of each spring 162 compounds to cause compression (e.g., symmetrical compression) of a beverage container inserted into the mouth 160 of the chuck 150. In some examples, a non-linear spring constant may be desired, such that the insertion force (i.e., the force required to insert a beverage container into the mouth 160) remains relatively constant from start to finish. However, in other examples, a linear spring constant may be utilized, such that the amount of insertion force may vary linearly as a function of deformation or deflection distance of the springs 162. In a similar fashion, the tube 152 may be generally frusto-conical to define a narrowing inner diameter and, thus, a narrowing mouth 160. Likewise, the springs 162 may have inwardly facing walls that are angled relative to the rotational axis A, such that the springs 162 project farther outwardly from the outer surface 158 of the tube 152 near the flared lip 154.

Turning back to the present example illustrated in FIG. 3, each spring 162 may be arranged to abut one of the ramps 136 and one of the teeth 134. More specifically, when the chuck 150 is inserted into the receptacle 138, each spring 162 engages at least one ramp 136 and one tooth 134. Each spring 162 may become slightly compressed and, thus, slightly deformed, as a result of its engagement with the ramp 136 and the tooth 134. In this way, the chuck 150, by way of the plurality of springs 162, nests within the receptacle 138 of the chassis 130. Further, the geometry, number, and arrangement of the springs 162 may be configured to provide particular performance properties during use with a beverage container.

As illustrated in FIGS. 3 and 4, the chassis 130 may further include a disc-shaped base 170 with a centrally located hub 172 from which support fins 174 extend outwardly, the support fins 174 being radially symmetrically spaced about the hub 172. Near the hub 172, the support fins 174 may have a similar depth or thickness as the hub 172, but each support fin 174 may gradually thin as it extends away from hub 172. The hub 172 may receive a drive shaft 176 that is rotatably coupled to the motor (not shown) for applying torque to the chassis 130 to cause rotation thereof about rotation axis A. In addition, a plurality of bearings 178 may be located in the base 170, the bearings 178 being spaced equidistant from and radially symmetrically about the hub 172. The tube 152 may extend downwardly from the base 170 and concentrically about the hub 172, such that each spring 162 is also spaced equidistant from and radially symmetrically about the hub 172. As such, the drive shaft 176 may be coupled to the chuck 150 by way of the chassis 130.

FIG. 4 illustrates an exploded view of the chassis 130 and the chuck 150. As illustrated in FIG. 4, the hub 172 may extend from the base 170 and may define an opening 180 therethrough. An axle 182 may extend from each bearing 178, and each axle 182 may be removably and rotatably received by clips 184 formed inside each corresponding aperture 186 of the base 170. The bearings 178 facilitate rotation of the chassis 130 within the housing 102 by reducing frictional forces when the motor (not shown) is actuated to rotate the drive shaft 176. In the present example, there are three bearings 178 and three apertures 186. It is contemplated that any suitable number of bearings 178 may be used and that multiple bearings 178 may be disposed within a single aperture 186. A side wall 188 may extend from a periphery of the base 170 and at an outward angle relative to a vertical axis extending through the opening 180.

With continued reference to FIG. 4, the side wall 188 may further include a plurality of notches 190 formed therealong, such that the notches 190 are radially symmetrically spaced about the hub 172 and extend from the base 170 toward a peripheral rim 192 that defines an outermost diameter of the chassis 130. The peripheral rim 192 may be coupled to the drive ring 132, thereby coupling the drive ring 132 to the base 170 to form the chassis 130. Further, the peripheral rim 192 can sealingly but rotatably couple the housing 102 with the chassis 130, thereby reducing or preventing moisture from traveling beyond the chassis 130 toward the motor (not shown) and power supply (not shown). Each notch 190 may have a generally trapezoidal shape with a narrow end positioned to interrupt a peripheral edge of the base 170 and a wide end located proximate the peripheral rim 192. Further, the number of notches 190 may correspond to the number of springs 162, as will be appreciated from the description below.

Still referring to FIG. 4, each spring 162 defines an apex 196 located at an end of the spring 162 opposite the outer surface 158 of the tube 152. A tab 198 may extend from the apex 196 of each spring 162, each tab 198 having a hook 200 that extends vertically above and inwardly from the tab 198 to form an arcuate profile. Each hook 200 may extend toward and above the inner gap 164 of each spring 162, and each tab 198 may extend laterally and outwardly from each apex 196 of each spring 162, such that the apex 196 is slightly offset from a center of the tab 198. Accordingly, there may be a plurality of tabs 198 and a plurality of hooks 200 spaced radially symmetrically about the tube 152, such that the plurality of tabs 198 define an outermost diameter of the chuck 150.

Turning to FIG. 5, a top perspective view of the chassis 130 and the chuck 150 is depicted with the chassis 130 shown partially transparent or translucent. As illustrated in FIG. 5, the chuck 150 is received within the receptacle 138 of the chassis 130 so that each tab 198 is aligned within each notch 190 and each hook 200 fits onto the base 170. To reach the assembled state depicted in FIG. 5, a user may perform the following steps: (a) orient the chuck 150 so that each tab 198 and hook 200 is radially offset from the ramps 136; (b) insert the chuck 150 into the receptacle 138 until the hooks 200 abut the base 170, (c) rotate the chuck 150 so that the tabs 198 slide within the drive ring 132 along the ramps 136 toward the teeth 134, and (d) ensure the tabs 198 fit into the respective notches 190 and the hooks 200 snap onto the base 170. In this way, the chuck 150 is removably installed within the chassis 130.

Because the chuck 150, including the tabs 198 and the hooks 200, may be formed of an elastic polymer material offering substantial flexibility, a user can manipulate the tabs 198 and the hooks 200 as needed to facilitate assembly with the chassis 130. However, because the material properties of the chuck 150 also include substantial resilience, the chuck 150 is securely fastened to the chassis 130, even against forces experienced during rotation of the chuck 150 during use and during repeated insertion and removal of a beverage container. In this manner, and in combination with its unique geometry, the chuck 150 is designed to grip, spin, and release a variety of beverage containers, while further being adapted for use within a variety of cooling mediums.

Figure 6:
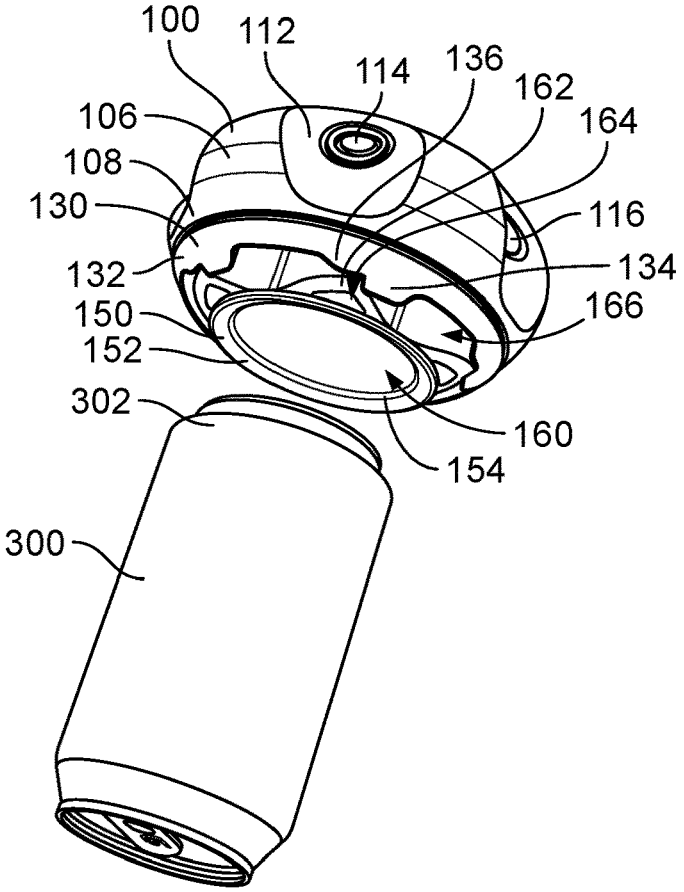
FIG. 6 is a bottom perspective view of a beverage container and a beverage cooling device before the beverage cooling device is mounted to the beverage container.

FIGS. 6 and 7 illustrate a bottom perspective view of a beverage container 300 and the beverage cooling device 100 according to some aspects of this disclosure. As illustrated in FIG. 6, the beverage cooling device 100 is fully assembled so that the chuck 150 is secured to the chassis 130. An exemplary process of using the beverage cooling device 100 includes aligning the mouth 160 of the tube 152 with an end 302 of the beverage container 300, inserting the end 302 of the beverage container 300 into the mouth 160, pressing the beverage container 300 and the beverage cooling device 100 together so that the tube 152 expands to fit around the end 302 of the beverage container 300; actuating the motor (not shown) by way of depressing the power button 114 on the housing 102; and placing the beverage cooling device 100 into contact with a cold medium (e.g., water, ice, etc.) so as to submerge the beverage container 300 while allowing rotation of the beverage container 300 by the motor (not shown) of the beverage cooling device 100. As a result, operation of the beverage cooling device 100 by way of depressing the power button 114 causes the motor (not shown) to apply torque to a drive shaft 176, which causes rotation of the hub 172, which causes rotation of the chassis 130, which causes rotation of the chuck 150, which causes rotation of the beverage container 300.

As illustrated in FIG. 7, the tube 152 of the chuck 150 may expand to fit around the end 302 of the beverage container 300. To accomplish this, the tube 152 may be designed to define an inner diameter of the mouth 160 that is less than an outer diameter of the beverage container 300. Further, as the beverage container 300 causes expansion of the tube 152, the plurality of springs 162 may be further compressed or deformed between the outer surface 158 of the tube 152 and the drive ring 132. As can be seen in FIG. 7, the inner gap 164 may be almost completely reduced by the outward movement of the outer surface 158 of the tube 152. Accordingly, the springs 162 exert a compressive force against the expansion of the tube 152 that is imparted to the beverage container 300. In combination with the particular material properties of the chuck 150, the inner surface 156 of the tube 152 may form a water-tight seal with the end 302 of the beverage container 300 that provides a firm grip even when submerged in water or ice. Further, the firm grip between the chuck 150 and the beverage container 300 is maintained during operation of the beverage cooling device 100, causing rotation of the beverage container 300.

Further, the outer gap 166 may also be reduced by the outward expansion of the outer surface 158 of the tube 152, but potentially, to a lesser extent than the inner gap 164. Accordingly, the outer gap 166 may leave room for further expansion or deformation or even asymmetrical expansion of deformation of the chuck 150. In this way, the chuck 150 may be configured to accommodate various sizes of beverage containers 300, or even irregularly shaped beverage containers 300.

Figure 8:
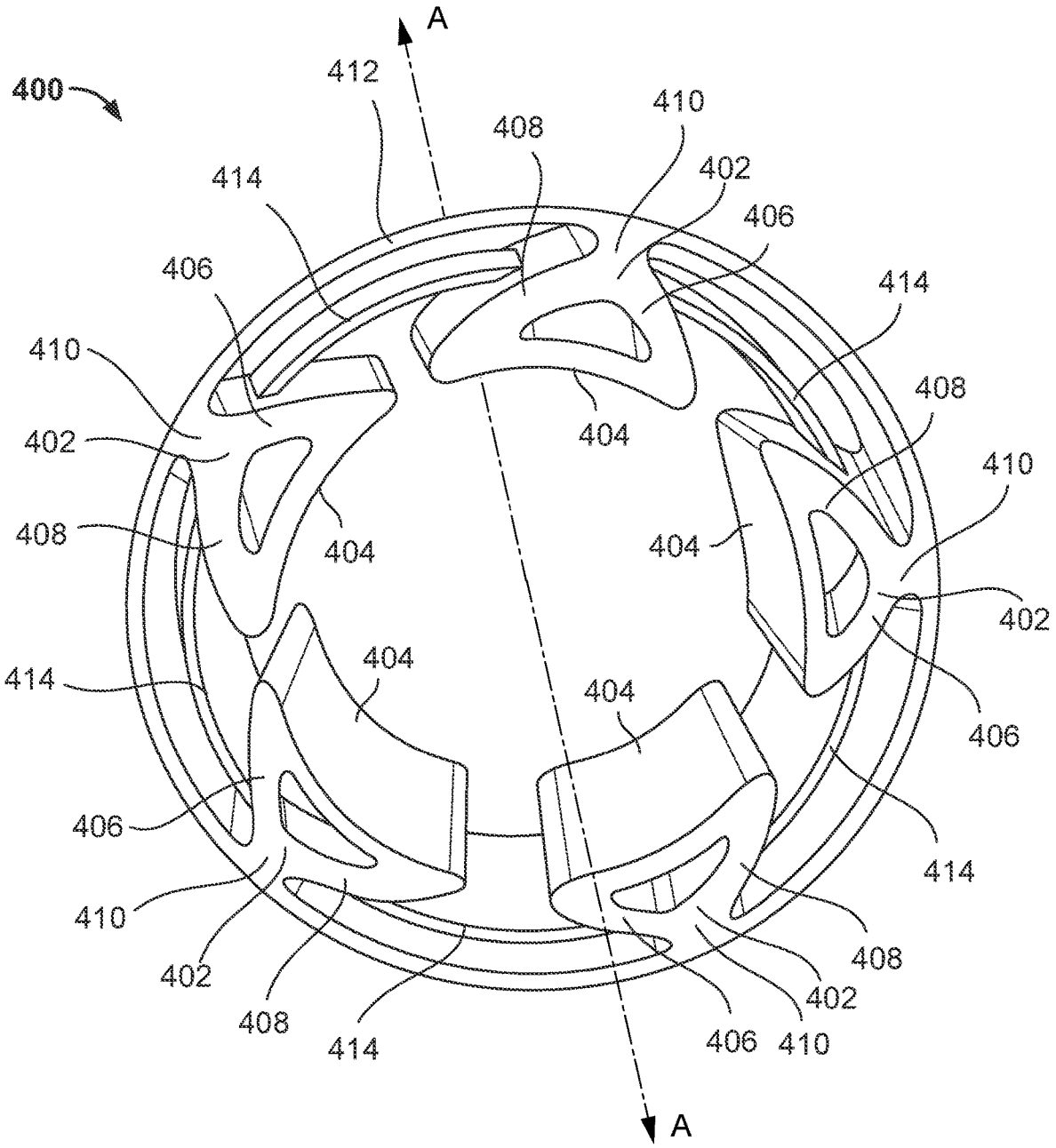
FIG. 8 is another embodiment of a chuck for use within the beverage cooling device.

FIG. 8 illustrates an alternative embodiment of a chuck 400. As illustrated in FIG. 8, a chuck 400 may include a plurality of springs 402 each having an inner wall 404 and two arms 406, 408 that connect at a peak 410. The springs 402 may be coupled to each other along a peripheral band 412 that attaches to the peak 410 of each spring 402, and the springs 402 may be radially spaced along the peripheral band 412. In addition, a bridge 414 may span between each of the springs 402, such as between the arm 406 of one spring 402 and the arm 408 of the adjacent spring 402, as illustrated in the embodiment of FIG. 8. Still, the chuck 400 is configured to receive a beverage container 300 by compressing each spring 402 between the beverage container 300 and the chassis 130. Each inner wall 404 may be convexly curved or concavely curved relative to its respective peak 410, or each inner wall may 404 may be substantially planar. It is also contemplated that the springs 402, or even the springs 162, may define a profile resembling an isosceles triangle, or an equilateral triangle, or a scalene triangle, or an irregularly shaped triangle (as illustrated). In addition, it is contemplated that like the spring 162, the springs 402 may be triangular- (as illustrated), rectangular-, trapezoidal-, cylindrical-, hexagonal-, or otherwise polygonal-shaped.

Further, each spring 402 is configured to exert a compressive force, i.e., a gripping force, when the beverage container 300 is inserted. In some examples, a non-linear spring constant may be desired, such that the insertion force remains relatively constant from start to finish. However, in other examples, a linear spring constant may be utilized, such that the amount of insertion force may vary linearly as a function of a deformation or deflection distance of the springs 162. For example, each inner wall 404 may be sloped or tapered in a direction parallel to the rotation axis A to provide a discontinuous frusto-conical aperture into which the beverage container 300 can be received, thereby gradually increasing the compressive force. Each of the springs 402 may be radially symmetrically spaced about the hub 172, when installed within the chassis 130 of the beverage cooling device 100. In this manner, each of the springs 402 is configured to be rotatably coupled to the motor (not shown) via the drive shaft 176, thereby imparting the rotation to the beverage container 300 when installed.

Figure 9:
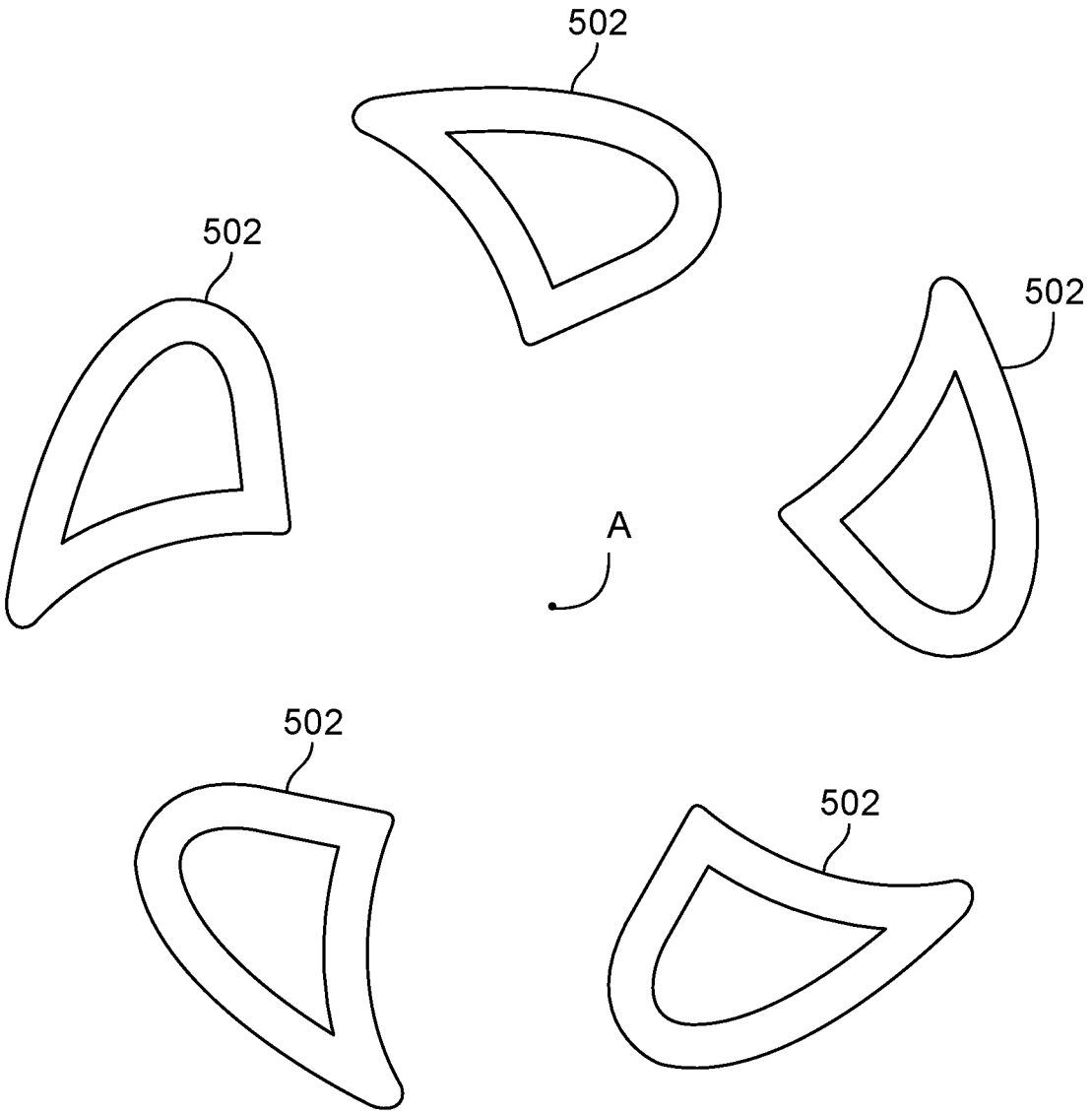
FIG. 9 is a bottom perspective view of a cross-section of another embodiment of a plurality of springs for use within the beverage cooling device.

FIG. 9 illustrates an example of a cross-section of another embodiment of a plurality of springs 502 with each spring 502 being irregularly shaped and radially spaced about rotational axis A. Optionally, the springs 402 may be separate from each other, without a tube or inner wall connecting them, such that each spring 402 can carry a tab 198 and a hook 200 for independent assembly with the chassis 130. In this way, the chuck 400 can be discontinuous.

Within the present disclosure, the word "exemplary" is used to mean "serving as an example, instance, or illustration." Any implementation or aspect described herein as "exemplary" is not necessarily to be construed as preferred or advantageous over other aspects of the disclosure. Likewise, the term "aspects" does not require that all aspects of the disclosure include the discussed feature, advantage or mode of operation. The term "coupled" is used herein to refer to the direct or indirect coupling between two objects. For example, if object A physically touches object B, and object B touches object C, then objects A and C may still be considered coupled to one another—even if they do not directly physically touch each other. For instance, a first object may be coupled to a second object even though the first object is never directly physically in contact with the second object.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but are to be accorded the full scope consistent with the language of the claims, wherein reference to an element in the singular is not intended to mean "one and only one" unless specifically so stated, but rather "one or more." Unless specifically stated otherwise, the term "some" refers to one or more. A phrase referring to "at least one of" a list of items refers to any combination of those items, including single members. As an example, "at least one of: a, b, or c" is intended to cover: a; b; c; a and b; a and c; b and c; and a, b and c. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. No claim element is to be construed under the provisions of 35 U.S.C. § 112(f) unless the element is expressly recited using the phrase "means for" or, in the case of a method claim, the element is recited using the phrase "step for."

It will be appreciated by those skilled in the art that while the invention has been described above in connection with particular embodiments and examples, the invention is not necessarily so limited, and that numerous other embodiments, examples, uses, modifications and departures from the embodiments, examples and uses are intended to be encompassed by the present disclosure and claims. The entire disclosure of each patent and publication cited herein is incorporated by reference, as if each such patent or publication were individually incorporated by reference herein.

What is claimed is:

1. A beverage cooling device comprising:
a housing having a top wall, a side wall, and a cavity;
a container engagement member rotatably coupled to the housing,
the container engagement member comprising:
an aperture for receiving an inserted beverage container; and
a plurality of spring members configured to deform upon insertion of the beverage container into the aperture and to provide a gripping force upon the beverage container.

2. The beverage cooling device of claim 1, wherein the spring members are radially symmetrically arranged.

3. The beverage cooling device of claim 1, wherein there are at least three spring members.

4. The beverage cooling device of claim 1, wherein the spring members are formed of a resilient material having an open, generally tubular shape and configured to provide a compressive force when a beverage container is inserted into the aperture.

5. The beverage cooling device of claim 1, wherein the spring members are configured to provide a gripping force that increases as the beverage container is inserted into the aperture.

6. The beverage cooling device of claim 1, wherein each spring member contacts an inwardly projecting tooth of a rotatable chassis, the rotatable chassis fixedly coupled to the container engagement member.

7. The beverage cooling device of claim 1, wherein the spring members are made of silicone.

8. The beverage cooling device of claim 1, wherein the container engagement member further includes a tube that at least partially defines the aperture, the tube having an outer surface on which the spring members are radially symmetrically arranged.

9. The beverage cooling device of claim 1, wherein the aperture is defined by a frusto-conical tube.

10. A beverage cooling device comprising:
a housing defining a cavity beneath a top wall;
a chassis disposed within the cavity of the housing, the chassis defining a receptacle beneath a base; and
a chuck disposed within the receptacle of the chassis,
wherein the base of the chassis includes a centrally located hub that defines an opening in which a drive shaft is received,
wherein the chuck is axially aligned with the hub,
wherein the chuck includes a plurality of collapsible projections radially spaced about the hub, and
wherein each projection is coupled to the chassis.

11. The beverage cooling device of claim 10, wherein each of the projections is a generally hollow, triangular-shaped tube.

12. The beverage cooling device of claim 10, wherein the chassis is sealingly engaged with the housing.

13. The beverage cooling device of claim 10, wherein the chassis includes a plurality of bearings.

14. The beverage cooling device of claim 10, wherein the chassis and the chuck are configured to rotate together.

15. The beverage cooling device of claim 10, wherein the chassis is composed of a rigid material and the chuck is composed of a flexible material.

16. A beverage cooling device comprising:

a housing having a top wall and a side wall with a lower end;

a rotatable chassis inside the housing; and a container engagement member secured to the rotatable chassis, wherein the container engagement member includes a plurality of spring members spaced apart from each other and spaced apart from the housing.

17. The beverage cooling device of claim 16, wherein the container engagement member is a unitary structure composed of silicone.

18. The beverage cooling device of claim 16, wherein the chassis includes a disc-shaped base coupled to a drive ring along a peripheral rim.

19. The beverage cooling device of claim 16, wherein the container engagement member is composed of a different material than the chassis.

20. The beverage cooling device of claim 16, wherein the container engagement member includes an aperture configured to receive at least a portion of a beverage container, the aperture being at least partially defined by a tube that includes an outer surface, and wherein the spring members are radially symmetrically arranged about the tube and coupled to the outer surface of the tube.

* * * * *